United States Patent [19]

Savelkouls

[11] Patent Number: 4,485,930

[45] Date of Patent: Dec. 4, 1984

[54] BOTTLE RACK

[75] Inventor: Wilhelmus Savelkouls, Den Dungen, Netherlands

[73] Assignee: 3 S Beton B.V., Grave, Netherlands

[21] Appl. No.: 363,012

[22] Filed: Mar. 29, 1982

[51] Int. Cl.[3] ..... A47B 73/00

[52] U.S. Cl. ..... 211/74; 211/184; 211/188; 211/194; 108/91; 108/53.3; 52/589; 52/593; 446/125

[58] Field of Search ..... 211/74, 194, 188, 184, 211/186, 43; 108/59, 91, 53.3; 52/593, 595, 596, 606, 513; 46/25, 24, 28, 23; 206/309; 312/9, 10

[56] References Cited

U.S. PATENT DOCUMENTS

| | | | |
|---|---|---|---|
| 1,238,112 | 8/1917 | Deterling | 312/10 |
| 2,132,757 | 10/1938 | Paulson | 46/25 |
| 3,643,814 | 2/1972 | Martin et al. | 211/177 |
| 3,870,155 | 3/1975 | Galloway | 211/188 X |
| 4,391,377 | 7/1983 | Ziaylek, Jr. | 211/194 X |

FOREIGN PATENT DOCUMENTS

| | | | |
|---|---|---|---|
| 933583 | 1/1948 | France | 211/186 |
| 983703 | 6/1951 | France . | |
| 1013231 | 4/1952 | France | 211/186 |
| 1116398 | 1/1956 | France | 52/593 |
| 1467849 | 12/1966 | France | 211/74 |
| 1572510 | 6/1969 | France . | |
| 240 | of 1888 | United Kingdom | 211/74 |
| 776734 | 6/1957 | United Kingdom | 211/74 |
| 1160056 | 7/1969 | United Kingdom | 211/74 |

*Primary Examiner*—Ramon S. Britts
*Assistant Examiner*—Blair M. Johnson
*Attorney, Agent, or Firm*—Fisher, Christen & Sabol

[57] ABSTRACT

The invention relates to a bottle rack comprising shelves provided on one side with adjacent cavities extending transversely of the direction of the length of the shelves for receiving the bottles and with spacing members arranged between the shelves. Each spacing member is constructed at one end in a manner such that the end concerned fits in at least one cavity.

2 Claims, 3 Drawing Figures

BOTTLE RACK

BACKGROUND OF THE INVENTION

1. Field of the Invention

The invention relates to a bottle rack comprising shelves having on one side cavities located side by side in a direction transverse to the direction of the length of the shelves for receiving the bottles and having spacing members arranged between the shelves.

2. Prior Art

Such a rack is known from French Pat. No. 1,572,510. In this known construction the spacing members are formed by partitions of rectangular section, which can be disposed only at those places where the shelves have matching, flat parts.

BROAD DESCRIPTION OF THE INVENTION

The invention has for its object to provide a rack of the kind set forth in which the spacing members can be arranged at any place between two superjacent shelves.

According to the invention this can be achieved in that the spacing member is constructed at one end in a manner such that the end concerned fits in at least one cavity provided in a shelf.

In contrast to the conventional construction, a rack embodying the invention permits in a simple manner the modifying of the array of the rack at any desired instant after the erection of the rack by displacing and/or adding or removing respectively loose spacing members, which will occupy a stable position in the cavity concerned.

It should be noted that from French Pat. No. 983,703 there is known a rack construction in which a shelf, in a cross-sectional view, has a profiled shape matching the form of the bottles to be supported. Between the ends of the shelves are arranged matching spacing members. In this case the shelves are not provided with cavities located side by side and extending transversely to the direction of the length of the shelves for receiving bottles or with similarly shaped ends of spacing members, while despite the loose disposition of these spacing members a stable structure can be obtained.

Furthermore U.S. Pat. No. 3,643,814 discloses a rack for storing goods construction from L-shaped or U-shaped parts. The array of such rack is mainly determined by the size of said parts E and such rack construction does not permit a stable disposition of loose spacing members in the manner according to the invention.

A further aspect of the invention relates to a method of manufacturing and transporting a concrete element, which in accordance with the invention is poured into a mould of synthetic resin foam, while the combination of the mould and the concrete element is transported to the place of use, where the mould is removed from the concrete element.

By using the method embodying the invention the concrete element can be made in a simple mould, which can, in addition, serve as packing material for the concrete element during its transport so that damage of the concrete element is practically excluded.

Since the manufacturer need not uncase the concrete element considerable time is saved in manufacturing the concrete elements. Moreover, wear of the moulds used only once does not occur so that a high accuracy of dimensions can be ensured.

BRIEF DESCRIPTION OF THE INVENTION

The invention is described more fully hereinafter with reference the embodiments of a rack in accordance with the invention shown in the accompanying Figures.

DETAILED DESCRIPTION OF THE INVENTION

Figure 1:
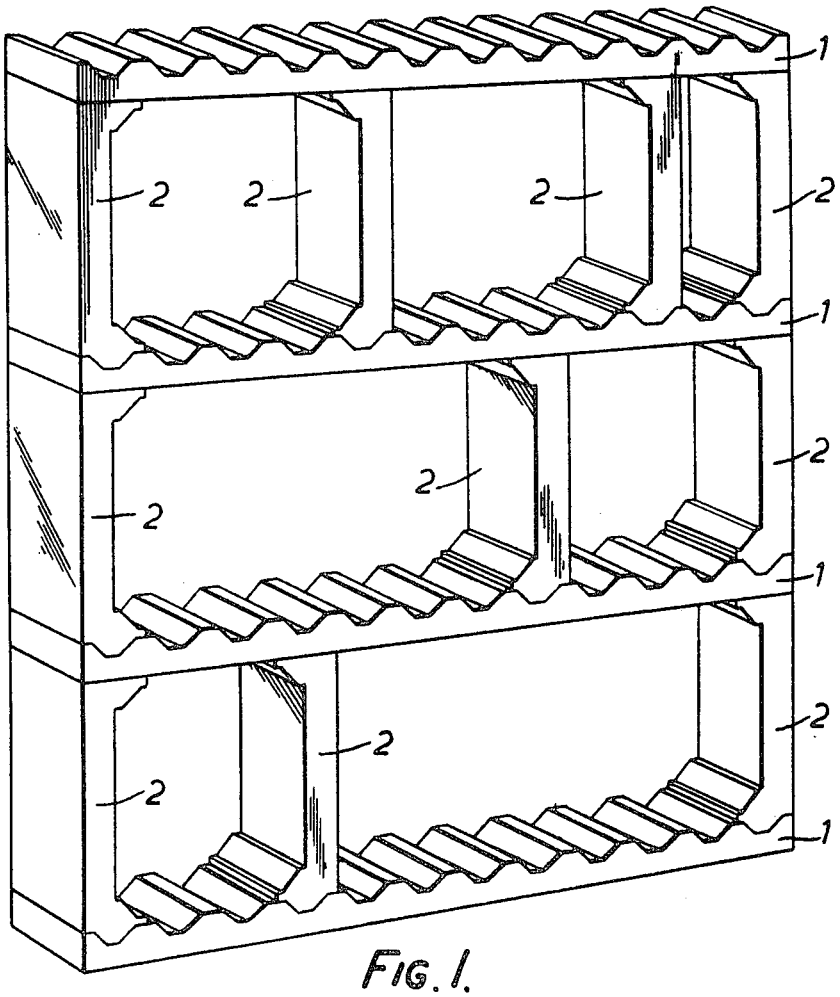
FIG. 1 is a perspective elevational view of one embodiment of a rack in accordance with the invention.
Figure 2:
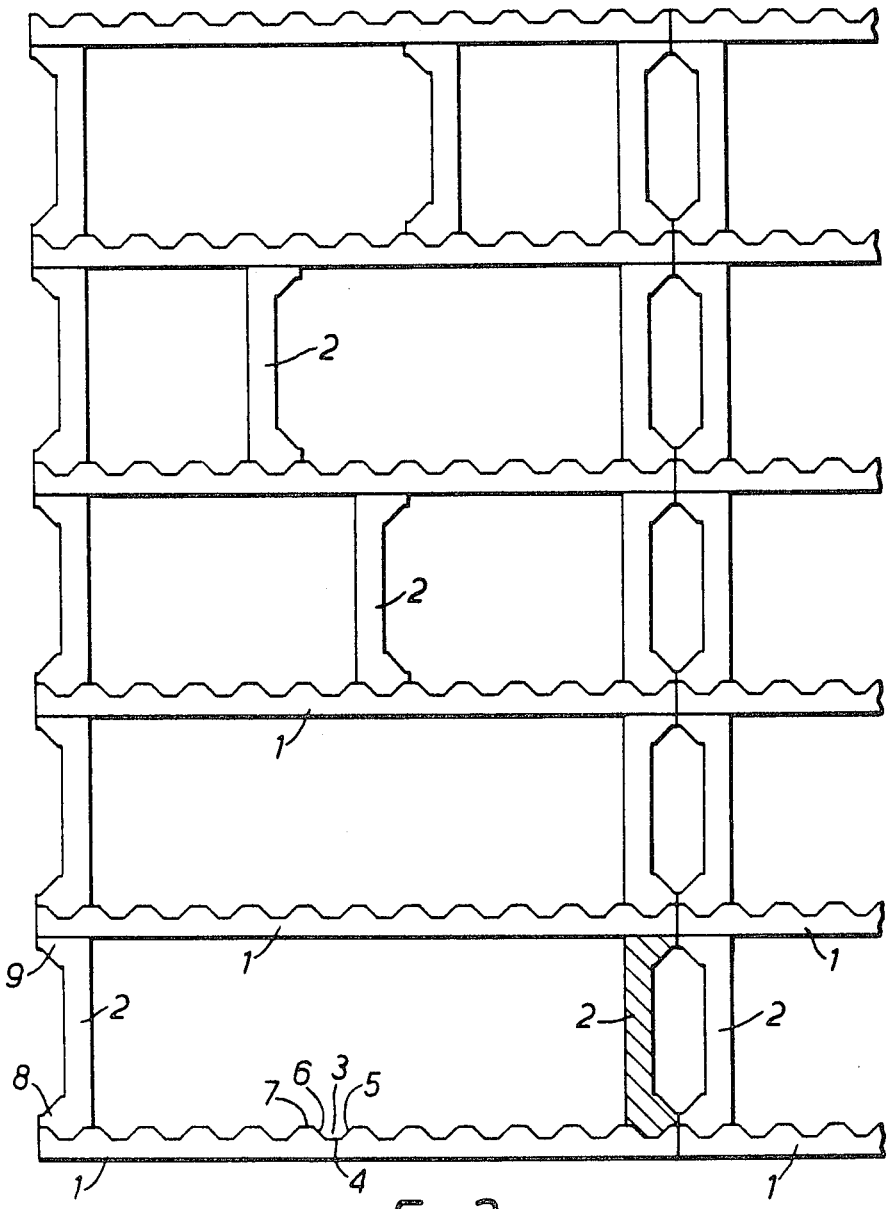
FIG. 2 is an elevational view of an embodiment of a rack in accordance with the invention.

As is shown in the FIGS. 1 and 2 the rack comprises a plurality of shelves 1, which are arranged one above the other in the embodiment shown in FIG. 1 and which, in the embodiment of FIG. 2, are also located in line with one another to form a rack of greater length than that shown in FIG. 1. Shelves 1 are held at a distance from one another with the aid of spacing members 2 arranged between the shelves.

Referring to the Figures, the top side of each shelf has a plurality of cavities 3, each of which are individually bounded by a boundary face 4 extending at least substantially horizontally in the direction of width of the shelf and by two diverging boundary faces 5 and 6 inclined upwards from the edges of boundary face 4. The top ends of the upwardly inclined boundary faces of neighbouring cavities 3 are connected with one another by boundary faces 7 extending parallel to boundary faces 4. The dimensions of cavities 3 are chosen so that all conventional models of wine bottles can be stored in the rack in a stable manner.

From the Figures it will furthermore be apparent that each spacing member is formed by a plate-shaped part, the lower end of which is provided with protruding nose 8 fitting in cavity 3 and having boundary surfaces by which nose 8 bears on boundary faces 7 of shelf 1 of the cavity receiving nose 8. It will be obvious that in this embodiment a stable support of the spacing member is provided by the subjacent shelf carrying the spacing member. On the top side each spacing member is provided with nose 9 having a flat top side for supporting the bottom side of superjacent shelf 1. The Figures show that such spacing members 2 can be disposed between the ends of two superjacent shelves. Moreover, as is also shown in Figures further correspondingly-shaped spacing members can be disposed at any desired place between spacing members 2 at the ends of shelves 1 for subdividing the spaces between the superjacent shelves into a plurality of compartments according to need with regard to the kinds of bottles to be stored in the rack.

In order to facilitate the insertion of the spacing members to be disposed between the spacing members at the ends of the shelves, a strip of tape-shaped material or the like may be disposed on top of noses 9 of the spacing members at the ends of the shelves so that ample space is available for slipping further spacing members in between the shelves concerned.

It will furthermore be apparent from the Figures that the spacing members are formed so that they can be disposed between the shelves both with the nose directed to the left and to the right, which provides inter alia the possibility of forming intermediate racks for lateral expansion.

The above-described elements of the rack i.e., the shelves and spacers 2, are preferably made from concrete, but as a matter of course they may be made from other material, for example, wood, synthetic resin or the like. The elements may be transported separately or in bundles from the factory to the user. When the elements are made from concrete, the invention provides an effective method of manufacturing and transporting such concrete elements. According to the invention the concrete elements are poured into moulds of synthetic resin foam, for example, polystyrene, and left in the moulds for transport so that the moulds serve in addition as packing material for the concrete elements. The user of the elements can remove the packing material formed by the mould from the elements at the place of destination of the rack and build up the rack in the desired form by means of said elements. As a matter of course, it is possible to use the proposed method of manufacturing and transporting concrete elements also for elements which may have the same or a different shape and be used for other purposes than the erection of a rack.

Figure 3:
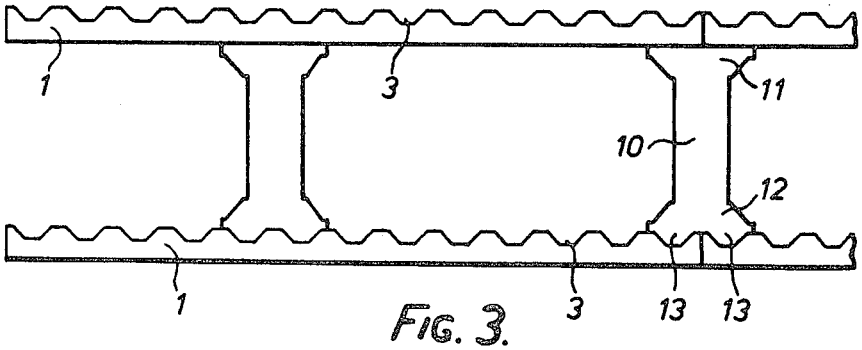
FIG. 3 shows a second embodiment of a spacing member.

FIG. 3 shows a second embodiment of a spacing member in accordance with the invention.

Spacing member 10 arranged between shelves 1 is provided with head piece 11 protruding on both sides out of the body and having a flat top side and with foot piece 12 having two adjacent, protruding noses 13 fitting in cavities 3.

Although this intermediate piece can also be disposed at any place between shelves 1, it is particularly suitable for disposition at the ends of the shelves, since with the aid of a single spacing member a connection or a support can be established between aligned shelves in the manner illustrated in FIG. 3.

As an additive to the concrete used for the manufacture of the rack components it is preferred to use marl or limestone.

I claim:

1. A bottle rack for the storage of bottles comprising shelves provided on one side with adjacent grooves extending transversely to the direction of the length of the shelves for receiving said bottles, the grooves extending completely across the shelves, and with spacing members arranged between the shelves, each spacing member being constructed at one end in a manner such that the end concerned fits in at least one groove, the grooves being separated from one another by at least substantially horizontal boundary faces of the shelf extending in the direction of width of said shelf, the bottom end of a spacing member being constructed so that it can bear in at least one groove and on parts of the shelf located on both sides of the groove, and the lower end of a spacing member being provided with two protruding noses fitting in two neighboring grooves.

2. A bottle rack for the storage of bottles comprising shelves provided on one side with adjacent grooves extending transversely to the direction of the length of the shelves for receiving said bottles, the grooves extending completely across the shelves, and with spacing members arranged between the shelves, each spacing member being constructed at one end in a manner such that the end concerned fits in at least one groove, the grooves being separated from one another by at least substantially horizontal boundary faces of the shelf extending in the direction of width of said shelf, the bottom end of a spacing member being constructed so that it can bear in at least one groove and on parts of the shelf located on both sides of the groove, and the distance between the end of a shelf and the center of a groove being equal to half the center-to-center distance between two neighboring grooves.

* * * * *